US006729931B2

(12) United States Patent
Lee

(10) Patent No.: US 6,729,931 B2
(45) Date of Patent: May 4, 2004

(54) TURBINE MECHANISM WITH DIRECTIONAL CONTROL FOR TOY WATERCRAFT

(75) Inventor: Keung Lee, New Territories (HK)

(73) Assignee: New Bright Industrial Co., Ltd., Kowloon (HK)

( * ) Notice: Subject to any disclaimer, the term of this patent is extended or adjusted under 35 U.S.C. 154(b) by 0 days.

(21) Appl. No.: 10/440,485

(22) Filed: May 19, 2003

(65) Prior Publication Data

US 2004/0002282 A1 Jan. 1, 2004

Related U.S. Application Data

(60) Provisional application No. 60/382,349, filed on May 23, 2002.

(51) Int. Cl.[7] ..... A63H 23/02

(52) U.S. Cl. ..... 446/160; 446/163; 446/165; 440/40

(58) Field of Search ..... 446/153–155, 446/160, 163–165; 440/38, 40

(56) References Cited

U.S. PATENT DOCUMENTS

| | | | | |
|---|---|---|---|---|
| 115,425 A | | 5/1871 | Boyman | |
| 1,197,181 A | | 9/1916 | Buck | |
| 3,046,697 A | * | 7/1962 | Pullen | 446/164 |
| 3,142,285 A | | 7/1964 | Sorrentino et al. | |
| 3,183,663 A | | 5/1965 | Sfredda | |
| 3,183,878 A | | 5/1965 | Aschauer | |
| 3,224,408 A | | 12/1965 | Sfredda | |
| 3,276,415 A | | 10/1966 | Laing | |
| 3,882,674 A | | 5/1975 | Taggart | |
| 3,889,623 A | | 6/1975 | Arnold | |
| 4,171,675 A | | 10/1979 | Thompson | |
| 4,238,928 A | | 12/1980 | Stupica | |
| 4,274,357 A | | 6/1981 | Dawson | |
| 4,538,996 A | | 9/1985 | Inwood | |
| 4,540,376 A | | 9/1985 | Turbowitz et al. | |
| 5,203,729 A | | 4/1993 | Beller et al. | |

FOREIGN PATENT DOCUMENTS

| | | | | |
|---|---|---|---|---|
| GB | 2153692 A | * | 8/1985 | A63H/23/00 |
| GB | 2 195 261 | | 4/1988 | |

* cited by examiner

*Primary Examiner*—H. Derris Banks
*Assistant Examiner*—Bena B. Miller
(74) *Attorney, Agent, or Firm*—Nixon & Vanderhye P.C.

(57) ABSTRACT

A turbine assembly with directional control for use in a toy watercraft, including: a turbine housing defining an impeller cavity and including a forward opening and a rearward opening; a directional control valve positioned in the impeller cavity and having a valve opening in a sidewall thereof, the directional control valve being operable to rotate to a first position which closes the forward opening in the turbine housing and aligns the valve opening with the rearward opening in the turbine housing, and a second position which closes the rearward opening in the turbine housing an aligns the valve opening with the forward opening in the turbine housing; and a motor driven impeller positioned in the directional control valve.

25 Claims, 6 Drawing Sheets

TURBINE MECHANISM WITH DIRECTIONAL CONTROL FOR TOY WATERCRAFT

RELATED APPLICATIONS

This application claims the benefit of Provisional Application No. 60/382,349, filed May 23, 2002, the entire content of which is hereby incorporated by reference in this application.

FIELD OF THE INVENTION

The instant invention relates to toy watercrafts, such as remote control toy boats and the like. More particularly, the invention relates to an improved turbine mechanism for toy watercrafts. In accordance with the invention, the improved turbine mechanism provides directional control for the toy watercraft that enables the watercraft to be selectively propelled in a forward direction and a backward direction, as well as enables the watercraft to be selectively turned in the left and right directions. The improved turbine mechanism includes an impeller that is housed within a directional control valve that moves in response to the rotational direction of the impeller between a first position that directs the water jet rearwardly and a second position that directs that directs the water jet forwardly. The watercraft is propelled in the forward direction when the directional control valve directs the water jet rearwardly, and is propelled in the backward direction when the directional control valve directs the water jet forwardly. Thus, in accordance with the invention, the forward/reverse direction of the watercraft is controlled by controlling the direction of rotation of the impeller, which, in turn, controls the position of the directional control valve and the resulting water jet direction. In the preferred embodiment, two turbine mechanisms of the present invention are provided on the watercraft in a side-by-side relationship. In this twin-engine embodiment, each of the turbines is individually controlled in a manner that enables the watercraft to be turned in the left and right directions as desired, in addition to operating in the forward and reverse directions. The invention provides a safe and cost effective propulsion system for toy watercrafts and the like.

BACKGROUND AND SUMMARY OF THE INVENTION

Toy vehicles have proven to be very popular toys for children of all ages. Many different types of toy vehicles have been provided in the past. For example, toy vehicles have been provided in the form of toy boats, toy cars, toy trucks, toy construction equipment, toy motorcycles and the like. Toy manufacturers are constantly trying to find ways to improve the operation of toy vehicles so that they look and function in a manner that is as real as possible and provide a safe toy for children, while also keeping the cost of the toy as low as possible. Many toy vehicles are made as miniaturized replicas of real full-size vehicles. Many such toys also include battery-driven motors that enable the toy to be self-propelled, thereby providing greater realism and further enjoyment for the user. Toy manufacturers are constantly looking for ways to make such toys safer, less expensive and more reliable, while still providing a fun and exciting toy.

Such toy watercrafts have been provided with remote control systems, such as radio frequency (RF) transmitters and receivers, which enable the user to remotely control the operation of the watercraft during operation. Other self-propelled toy watercrafts have been provided without remote control functionality, wherein the user simply turns on or off the power to the watercraft and the watercraft operates without user control.

Toy watercrafts have been provided with propeller and jet drive systems for propelling the watercraft across water. In propeller drive systems, a propeller is provided that is driven by a drive shaft connected to a motor, such as a miniature electric motor, housed within the watercraft. A rudder and steering control box are typically provided for directional control of propeller-driven toy watercraft. Such propeller-driven toy watercrafts have been provided in the past in a variety of forms and have proven to be a very popular toy for children of all ages. However, such prior propeller-driven toy watercrafts have had some disadvantages. For example, the structure of the drive shaft assembly of prior toy watercrafts have enabled water to enter the hull of the boat, thereby causing a significant amount of water to collect in the hull of the watercraft when floating or operating in water. Prior toy watercrafts have used epoxy glue, resin and/or grease around the propeller shaft in an attempt to reduce or prevent water from entering the hull. However, these prior techniques have not eliminated the problem of water entering the hull around the drive shaft assembly.

Drain holes have typically been provided in prior toy watercrafts to enable the user to periodically drain the collected water from the watercraft housing by removing the watercraft from the water and inverting the watercraft, so that the hull water drains out through the drain holes. The frequency at which the user must drain the boat hull depends on the rate at which the propeller assembly allows water to enter the hull. Many of the prior toy watercrafts have required frequent draining, thereby reducing the enjoyment of the toy. Not only can the water entering the hull cause damage to the internal parts of the toy watercraft, but it also adds substantial additional weight to the watercraft, which adversely effects the operation thereof. The additional weight of even a relatively small amount of water in the hull can prevent the watercraft from performing optimally. Larger amounts of water in the hull can prevent the watercraft from balancing or planing on the surface of the water, thereby dramatically reducing the performance and enjoyment of the toy watercraft.

Another disadvantage of propeller driven toy watercraft is that the propeller drive shaft assembly is typically constructed in a manner that enables the drive shaft to vibrate significantly during operation, thereby decreasing the efficiency and performance of the toy watercraft during operation. A further disadvantage of such prior propeller drive assemblies is that they are relatively noisy during operation, which also results in (or is indicative of) less than optimal performance for the drive assembly. Yet another disadvantage of prior propeller-driven toy watercraft designs is that the manner in which the propeller is attached to the propeller shaft adversely impacts the propeller performance. For example, prior propellers have been attached to the shaft in a manner that creates an unsymmetrical or unbalanced condition which, during high rotational speed, causes turbulence and/or vibration that prevents the propeller from performing optimally. One example of a prior propeller attachment method is to use a fastener, such as a screw, through the side of the propeller and into contact with the shaft. Prior propeller attachment methods have also made it difficult or impossible to replace the propeller in the event that the propeller becomes damaged, such as by an impact with another object. Even slight damage to the propeller can seriously reduce the operational efficiency thereof. Major propeller damage, such as loss of one or more propeller blades, can render the toy inoperative. If the damaged propeller cannot be replaced, the toy can no longer be enjoyed by the user. A further disadvantage of prior toy watercraft designs is that the connection between the shaft and the motor is not done in a way that assures reliable and maximum transfer of power from the motor to the shaft. A still further disadvantage of propeller driven toy watercraft is that the propeller is exposed and can result in injury to the operator or other party if they contact the spinning propeller during operation of the toy.

All of the above-noted disadvantages of prior propeller-driven toy watercraft designs contribute to a less than ideal product from the end-user's perspective. Such toys are typically purchased with the hope and/or expectation that the watercraft will perform optimally and for a long period of time. These expectations are not always met by prior toy watercraft designs as a result of one or more of the above-noted problems and/or other problems with the propeller drive shaft assembly. Moreover, propeller-driven toy watercraft drive assemblies can be relatively complex, expensive, difficult to assemble, and/or subject to damage or failure. The instant inventor has addressed many of these problems with propeller-driven toy watercraft in U.S. patent application Ser. No. 09/997,486 entitled "Propeller Shaft Assembly for Toy Watercraft" filed Oct. 16, 2001, the disclosure of which is incorporated by reference herein. However, a need exists for an improved propulsion system for toy watercrafts that eliminates the need for a propeller, but still provides directional control for the watercraft.

Jet-driven toy watercrafts are also known. For example, toy watercraft have been provided that replicate a jet ski or jet boat. The drive systems for jet-driven toy watercraft typically include an impeller connected to a miniature electric motor that drives the impeller in a manner that creates a water jet force that propels the watercraft in the direction of the jet force. While jet drives provide reliable propulsion for the watercraft, the problem that arises is how to provide directional control for a jet driven toy watercraft, without the use of the rudder and associated steering control box provided on propeller-driven watercrafts. One technique for providing left/right directional control for watercrafts having jet drives is to provide a moveable output nozzle for the water jet which can selectively direct the water jet to one side or the other, thereby imparting a turning force to the watercraft. This technique, however, does not enable forward/reverse control for the watercraft, and also requires an expensive and relatively complex jet nozzle assembly. Another technique used to control the forward/reverse direction of jet watercraft is to provide a U-shaped bucket that can selectively redirect the water jet forwardly by moving the U-shaped bucket into the water jet stream in a manner that causes a redirection thereof after the water jet exits the jet nozzle. The redirected water jet provides a rearward jet force on the watercraft, thereby enabling the watercraft to be propelled in the rearward direction. While this technique does provide forward/reverse directional control for the watercraft, the U-shaped bucket, mechanical linkage and control assembly are relatively complex and expensive, particularly for toy watercrafts. The moving parts associated with the bucket system are also subject to damage and/or malfunction. A variety of other, related techniques have been developed for controlling jet powered watercrafts. Some exemplary (but by no means exhaustive) prior art impeller-type watercrafts are shown in U.S. Pat. Nos. 115,425 to Boyman; 1,197,181 to Buck; 3,046,697 to Pullen; 3,142,285 to Sorrentino et al.; 3,183,663 to Sfredda; 3,183,878 to Aschauer; 3,224,408 to Sfredda; 3,276,415 to Laing; 3,882,647 to Taggart; 3,889,623 to Arnold; 4,238,928 to Stupica; 4,274,357 to Dawson; 4,538,996 to Inwood; 4,540,376 to Turbowitz et al.; 5,203,729 to Beller et al.; as well as GB 2 195 261 to Tong. While these and other jet watercraft systems provide various techniques for operating and controlling impeller or jet-type watercraft, they are all relatively complex, expensive to manufacture and/or are not particularly well suited for use in connection with a jet-powered toy watercraft. Thus, further improvements in directional control systems for jet-powered toy watercrafts are desired.

The instant invention is designed to address these and other problems with prior art toy watercraft designs by providing an improved turbine (or jet drive) mechanism for toy watercrafts that can be used in connection with, for example, radio control full function toy boats and the like. The improved turbine mechanism enables safe, reliable and efficient directional control for toy watercrafts, without requiring any complex or expensive mechanical parts or assembly.

In accordance with the invention, a directional control valve is used to selectively propel the watercraft in the forward or reverse directions. A water impeller (or rotor) is housed inside the directional control valve and the valve is in a racket-shaped recess in the bottom of the boat. The recess has a front and a rear opening. The directional control valve is designed to rotate within the recess such that only one of the front and rear openings is open at any one time. The valve rotates under the jet force of the water between first and second positions defined by cooperating guiding ribs on the valve and the recess in the hull. The valve is selectively moved between the first and second positions in response to the rotation direction of the impeller. In the first position, the valve closes the forward opening in the recess and enables the water jet created by the impeller to exit the rear opening in the recess, thereby propelling the watercraft in the forward direction. In the second position, the valve closes the rear opening in the recess and enables the water jet created by the impeller to exit the front opening in the recess, thereby propelling the watercraft in the rearward direction. Thus, by changing the direction of the impeller rotation (using an RF remote control or the like) the position of the valve is moved and the forward/reverse direction of the watercraft is controlled. When two such turbine mechanisms are used in side-by-side relation on the hull of the watercraft, the watercraft can also be controlled to turn in the left and right directions either by operating one turbine at a time or by operating the turbines at different speeds and/or in different directions. In this way, the invention provides a safe, reliable and low-cost propulsion and directional control system for toy watercraft that overcomes many of the disadvantages of prior toy watercraft designs.

In accordance with a primary aspect of the invention, a turbine assembly for use in a toy watercraft is provided which includes: a turbine housing defining an impeller cavity and including a forward opening and a rearward opening; a directional control valve positioned in the impeller cavity and having a valve opening in a sidewall thereof, wherein the directional control valve is operable to rotate to a first position which closes the forward opening in the turbine housing and aligns the valve opening with the rearward opening in the turbine housing, and a second position which closes the rearward opening in the turbine housing and aligns the valve opening with the forward opening in the turbine housing; and an impeller positioned in the directional control valve, wherein rotation of the impeller in a first direction causes the directional control valve to move to the first position and rotation of the impeller in a second direction causes the directional control valve to move to the second position.

In accordance with another aspect of the invention, a toy watercraft is provided which includes: a watercraft housing having a hull portion; a motor; a motor control system for selectively energizing the motor and controlling the direction of operation thereof; and a turbine assembly in the hull portion of the watercraft, wherein the turbine assembly includes: a turbine housing defining an impeller cavity and including a forward opening and a rearward opening; a directional control valve positioned in the impeller cavity and having a valve opening in a sidewall thereof, wherein the directional control valve is operable to rotate to a first position which closes the forward opening in the turbine housing and aligns the valve opening with the rearward opening in the turbine housing, and a second position which closes the rearward opening in the turbine housing and aligns the valve opening with the forward opening in the turbine housing; and an impeller operatively connected to the motor and positioned in the directional control valve, wherein rotation of the impeller in a first direction causes the directional control valve to move to the first position and rotation of the impeller in a second direction causes the directional control valve to move to the second position. In this way, the watercraft can be selectively propelled in the forward and reverse directions by controlling the direction of rotation of the impeller.

In accordance with a further aspect of the invention, a toy watercraft, is provided which includes two of the above-described turbine assemblies in side-by-side relation on the hull of the watercraft. A pair of miniature electric motors are used to individually control the speed and direction of rotation of each motor. In this way, the watercraft is controlled, using a remote control unit or the like, to operate in the forward and reverse directions, as well as in right and left turning directions.

BRIEF DESCRIPTION OF THE DRAWINGS

These and other objects, features and advantages of the instant invention will become apparent from the following detailed description of the preferred embodiments of the invention when read in conjunction with the appended drawings, in which.

DETAILED DESCRIPTION OF THE PREFERRED EMBODIMENTS

Figure 1:
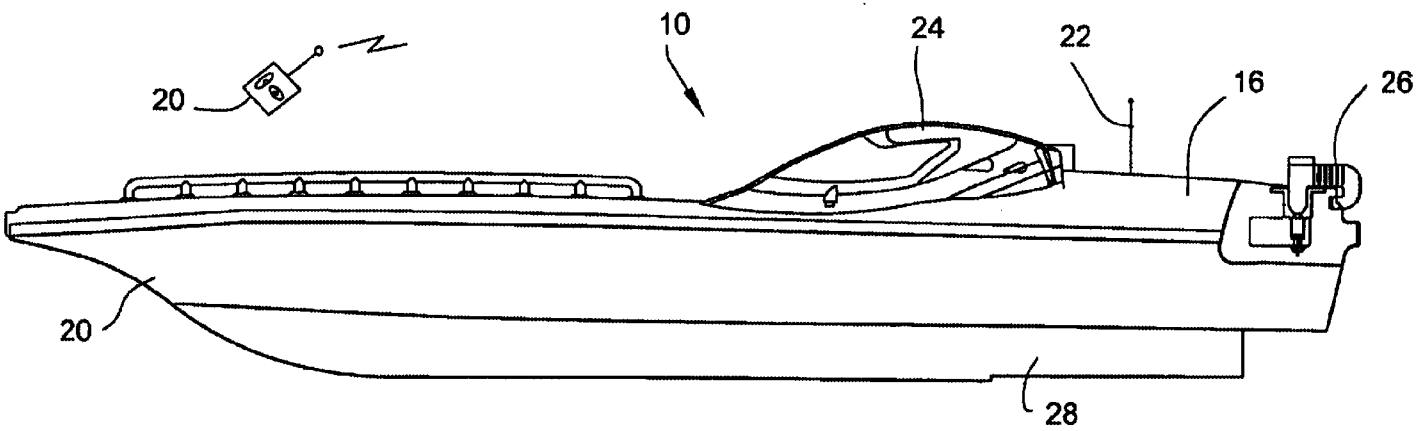
FIG. 1 shows an exemplary toy watercraft of a type to which the instant invention is directed, and having a pair of the improved turbine mechanisms of the instant invention incorporated therein.

The preferred embodiments of the instant invention will now be described with reference to the drawings. The embodiments described are only exemplary and are not meant to limit the scope of the invention beyond the express scope of the appended claims. In connection with the drawings, like reference numerals represent similar parts throughout the various views.

Figure 2:
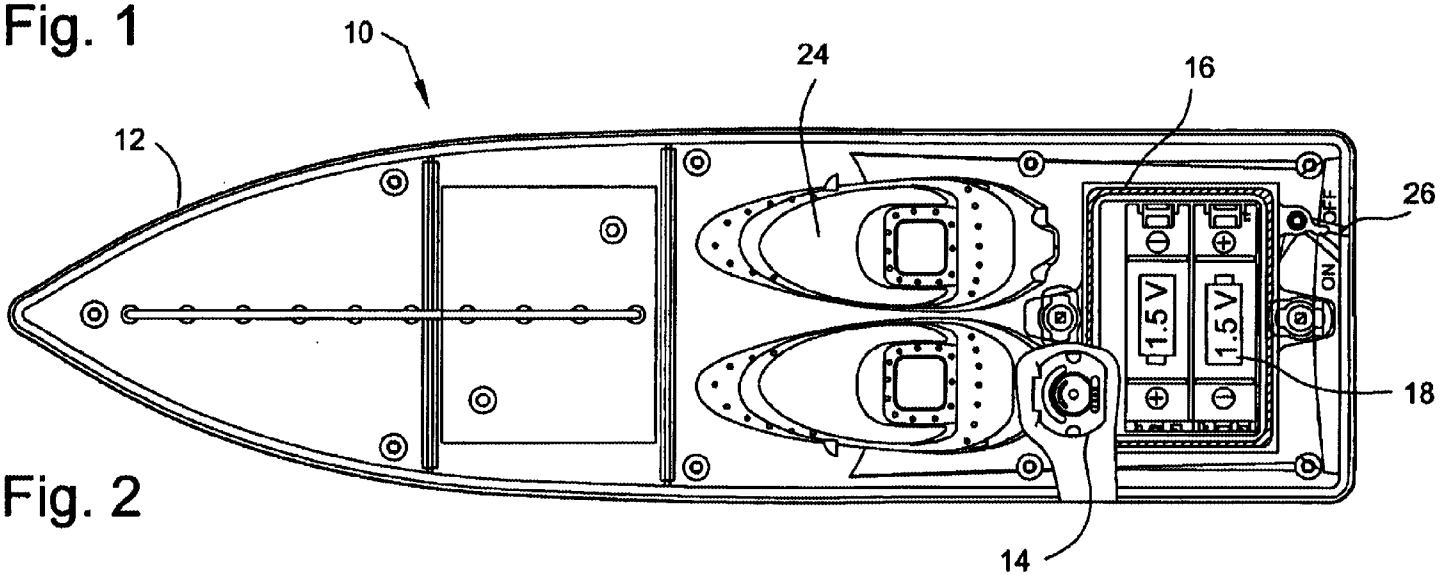
FIG. 2 shows a top view, partially cut away to show a miniature electric motor therein, of the exemplary toy watercraft of FIG. 1.

FIG. 1 shows an exemplary toy watercraft 10 in the form of a miniaturized boat. The instant invention is applicable to any suitable toy watercraft that is powered by a jet drive or turbine mechanism, such as toy boats, toy personal watercrafts (such as a toy "Jet Ski") and the like. The toy watercraft 10 includes an outer housing 12 preferably made from a suitable plastic or other material that enables the toy watercraft to float in water and be very durable. The housing 12 may be comprised of, for example, upper and lower housing sections that are joined together, in a known manner, during assembly of the toy. At least one miniaturized motor 14 (see, e.g., FIG. 2) is contained within the toy watercraft's housing 12 for driving the turbine mechanism of the instant invention for propelling the watercraft 10 through the water when the at least one motor 14 is energized, thereby providing a fun and exciting toy that simulates a real working watercraft. In this embodiment, two turbine mechanisms of the instant invention are incorporated in the rear hull portion 28 of the watercraft housing 12. However, other embodiments may be provided with only one turbine mechanism of the instant invention. A battery compartment 16 is provided in the watercraft housing 12 for holding one or more batteries 18 for powering the watercraft 10. In the particular embodiment of FIG. 1, the watercraft includes an enclosed cockpit section 24, thereby simulating a high-speed racing boat. This embodiment also includes a wireless battery switch 26 of the type disclosed by the instant inventor in U.S. patent application Ser. No. 09/977,493 filed Oct. 16, 2001 and entitled "Wireless Battery Switch," the disclosure of which is incorporated herein by reference. However, any suitable power switch system can be used.

The watercraft 10 may be remotely controlled by an operator using, for example, an appropriate wireless transmitter 20. In this embodiment, the toy watercraft 10 includes an antenna 22 for receiving control signals from the wireless transmitter 20. The wireless transmitter 20 is used in this embodiment to send forward, reverse and turning commands to the toy watercraft during operation. The manner in which forward/reverse and left/right turning of the toy watercraft is achieved by the turbine mechanism of the instant invention will be described in detail below.

The toy watercraft is preferably constructed and designed to simulate a real watercraft, such as a jet ski, boat or other type of watercraft, thereby providing a realistic but miniaturized toy watercraft that can be played with in water, such as in a pool, pond, lake or other suitable body of water. The overall design and construction of toy watercrafts, such as that shown in FIG. 1, are generally known to those skilled in the art of toy design and manufacture. Thus, no further specific details regarding the particular watercraft itself will be provided herein, so as not to obscure the description of the improved turbine mechanism of the instant invention with unnecessary details. The remaining description herein will focus primarily on the turbine mechanism itself and explain how the invention can be incorporated into watercraft toys.

Figure 3:
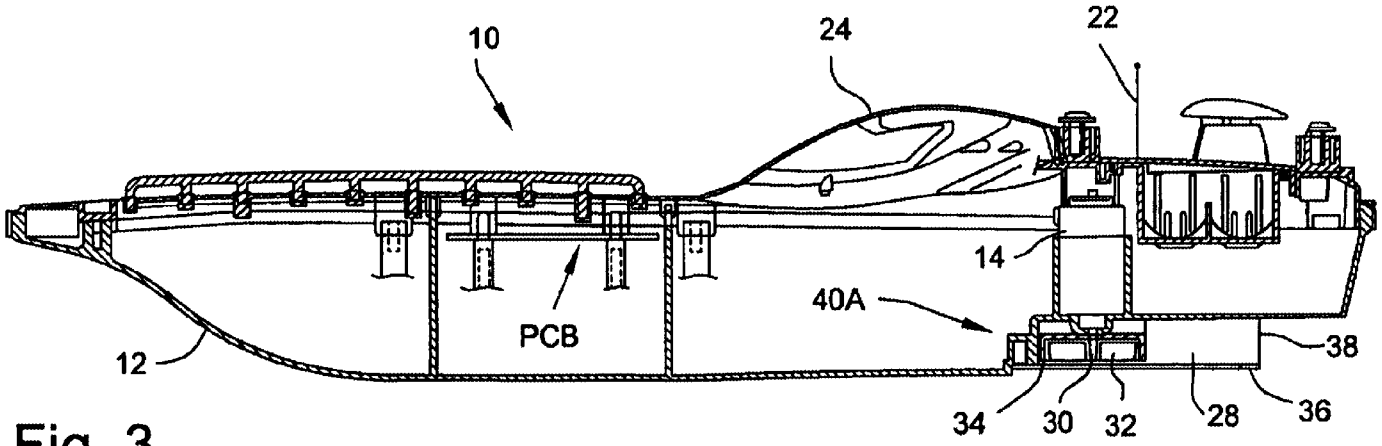
FIG. 3 shows a side, sectional view of the exemplary toy watercraft of FIG. 1.

FIG. 3 shows a sectional view of the exemplary watercraft of FIG. 1. In this view, one (40A) of the two turbine mechanisms (40A, 40B) of the instant invention can be seen. Turbine mechanism 40A is incorporated into the hull portion 28 of the watercraft. The turbine mechanism includes a recess in the hull portion 28 that defines a turbine housing. A directional control valve 34 for the turbine mechanism 40 is positioned in the turbine housing. A drive shaft 30 of the miniature motor 14 extends into the turbine housing, through the directional control valve, and connects with an impeller (or rotor) 32. The turbine housing includes a rear opening 38 and a forward opening 42 (see, e.g., FIG. 4). A cover plate 36 covers the turbine housing to enclose the impeller 32 and directional control valve 34 therein and complete the water jet structure of the turbine mechanism. The cover plate 36 includes openings 44 for enabling the spinning impeller to draw water therethrough and into the turbine mechanism for creating a water-jet thrust to propel the watercraft 10 through the water. In other words, when the motor drives the impeller, water is drawn into the turbine mechanism and forced out one of the openings 38 or 42 (depending on the position of the directional control valve) in a manner that causes a water jet force on the watercraft sufficient to propel the watercraft through the water. Depending on the power and speed of the motor and the size of the parts used in the turbine mechanism, a strong propulsion force can be generated to propel the watercraft at practically any desired speed. As will be explained in greater detail below, the position of the directional control valve 34 is used to selectively direct the water jet rearwardly (through opening 38) for forward propulsion of the watercraft or forwardly (through opening 42) for backward propulsion of the watercraft. A printed circuit board (PCB) may be provided in the position shown in FIG. 3 for processing the control signals for the watercraft and controlling the operation of the miniature motors 14 based thereon.

Figure 4:
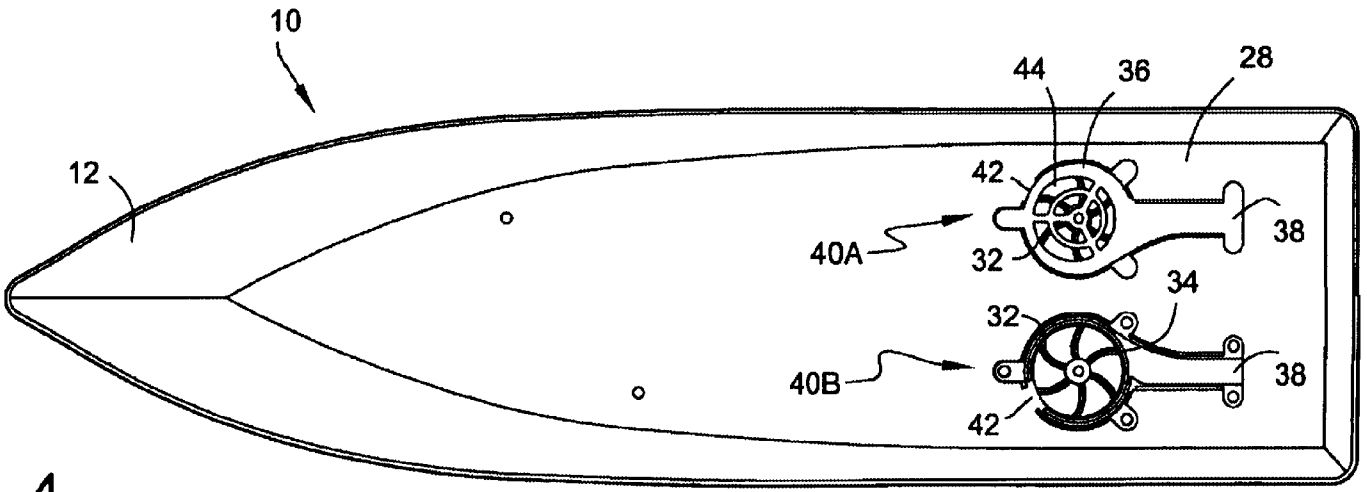
FIG. 4 shows a bottom view of the exemplary toy watercraft of FIG. 1.

FIG. 4 shows a bottom view of the watercraft of FIG. 3. As can be seen in FIG. 4, this embodiment of the invention includes a two turbine mechanisms (40A, 40B) of the instant invention positioned in the hull portion 28 of the watercraft 10 in side-by-side relation. The first turbine mechanism 40A has a cover plate 36 mounted thereon, while the second turbine mechanism (40B) has the cover plate 36 removed to expose the impeller 32 and directional control valve 34. As can also be seen in FIG. 4, the forward opening 42 in the turbine housing of each of the turbine mechanisms 40A, 40B faces slightly outwardly, but still in the generally forward direction. However, the forward opening 42 may face directly forward or in any other suitable forwardly facing direction, depending on the particular application in which the invention is employed. The same is true for the rear opening 38 of the turbine mechanism, i.e., it does not necessarily have to face directly in the rearward direction, as long as the direction still results in some forward thrust on the watercraft when operated. In another embodiment (not shown) where only one turbine mechanism is used on the watercraft, the forward opening 42 preferably faces directly forward and the rearward opening 38 preferably faces directly rearwardly, thereby providing forward/reverse control using a single turbine mechanism positioned in the center of the rear portion 28 of hull of the watercraft.

Figure 5:
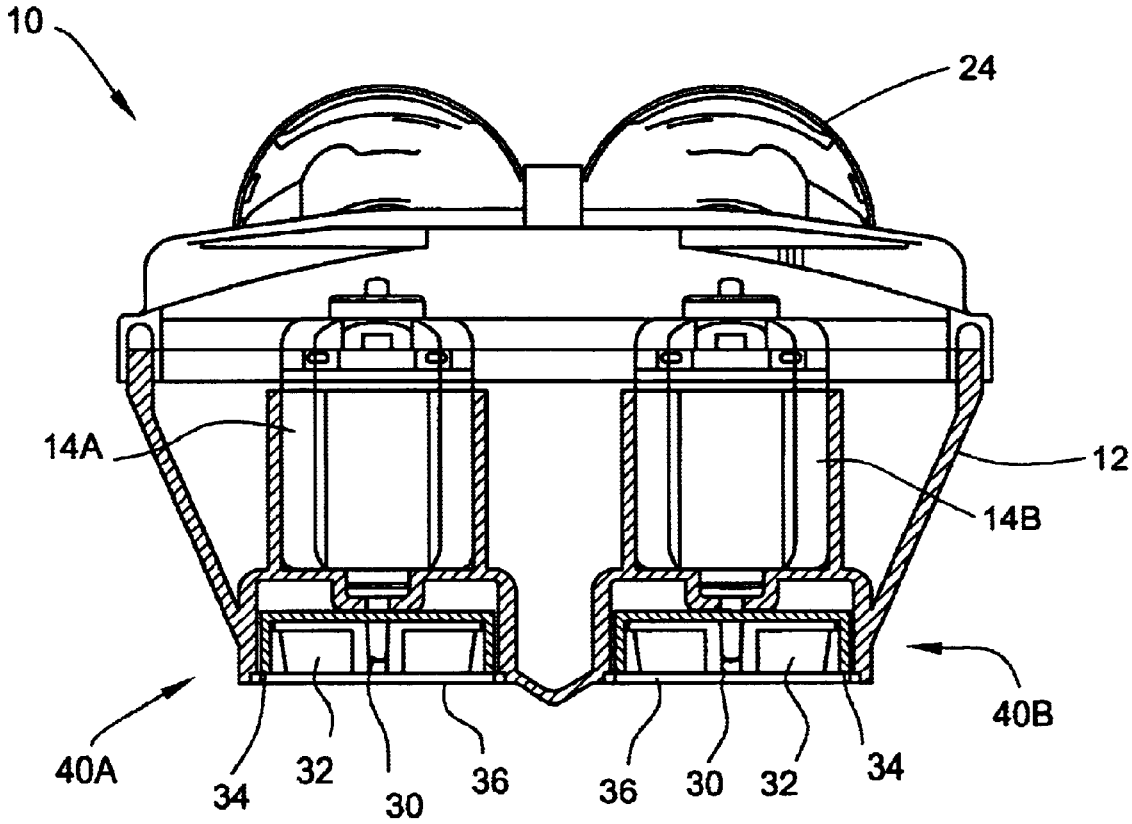
FIG. 5 shows a rear sectional view of the exemplary toy watercraft of FIG. 1.

FIG. 5 shows a rear, sectional view of the watercraft of FIGS. 1–4. As shown in FIG. 5, each of the turbine mechanisms 40A, 40B, have their own miniature motor 14A, 14B, respectively, for driving the impellers 32. The control system of the watercraft preferably enables each of the motors 14A, 14B to be individually controlled with respect to speed and direction. Thus, by increasing the speed of the two motors, the speed of the watercraft is controlled. In addition, by changing the direction of rotation of the motors (and thereby the impellers), the watercraft is operated in the reverse direction. The left/right turning of the watercraft is controlled by operating only one of the turbines, or selectively operating one of the turbines at a faster or slower speed (or even a reverse speed) relative to the other turbine. In this way, the twin-engine toy watercraft can be operated in a manner that simulates an actual twin-engine watercraft with individual engine control, by enabling forward, reverse, right, left and spin operations to be performed.

Figure 6:
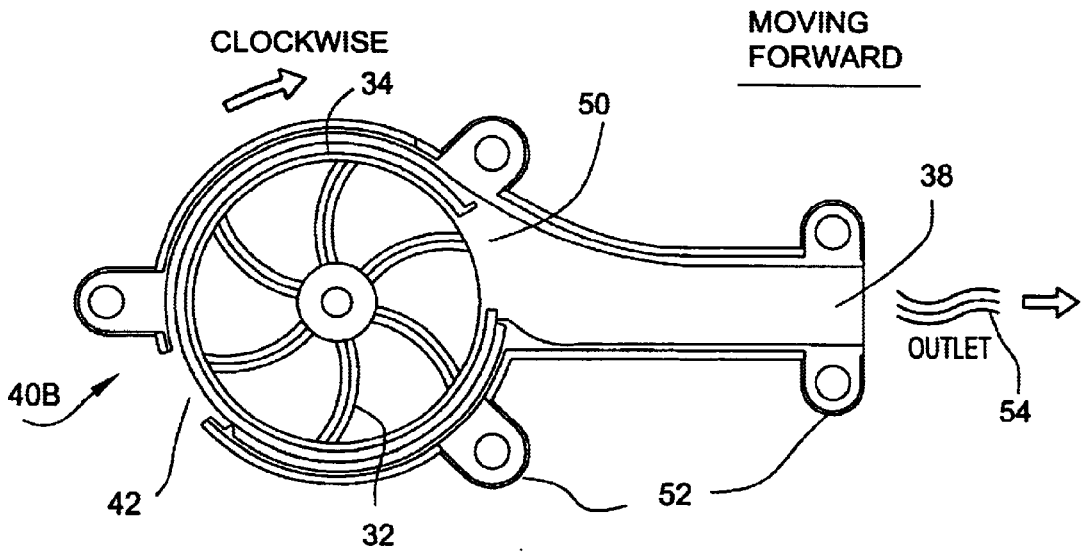
FIG. 6 shows a top view of a preferred embodiment of the improved turbine mechanism of the present invention being operated in a clockwise direction, thereby causing the water jet to exit a rear opening for forward propulsion of a watercraft.
Figure 7:
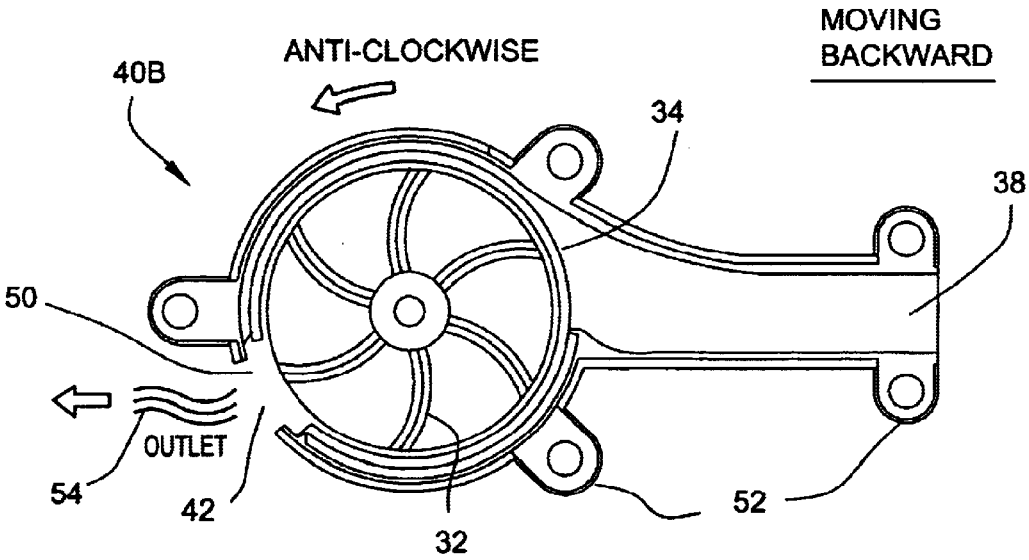
FIG. 7 shows a top view of a preferred embodiment of the improved turbine mechanism of FIG. 6 being operated in a counter-clockwise direction, thereby causing the water jet to exit a forward opening for rearward propulsion of a watercraft.

FIGS. 6 and 7 show larger views of the second turbine mechanism 40B of FIGS. 4 and 5. These figures illustrate how the directional control valve 34 controls the direction of the water jet 54 produced by the turbine mechanism of the instant invention. Specifically, FIG. 6 shows the rotational position of the directional control valve when the impeller 32 is driven by the motor in a clockwise direction. The directional control valve 34 has an opening 50 in the sidewall thereof, defining two edges of the opening. When the impeller spins clockwise (as shown in FIG. 6), the water flow impacts one of the edges and, as a result, causes the directional control valve to rotate to the position shown in FIG. 6. In this position, the directional control valve 34 closes the forward opening 42 in the turbine housing and aligns its opening 50 with the rearward opening 38, thereby directing the water jet 54 rearwardly for forward propulsion of the watercraft. The edges of the opening (50) in the directional control valve (34) preferably have outwardly projecting ribs (78A/78B, see FIGS. 8, 9) thereon which cooperate with inwardly facing guides or stops (68/70) on the turbine housing (60) to stop the rotation of the directional control valve (34) when the opening (50) therein is aligned with the rearward (38) (or forward(42)) opening in the turbine housing (60) (depending on the rotation direction of the impeller). FIG. 7 shows the position of the directional control valve when the impeller is driven in the counterclockwise direction. In this direction, the water impacts the other edge of the opening in the directional control valve causing the valve to rotate to the second position shown in FIG. 7. In this position, the directional control valve closes the rear opening 38 in the turbine housing and aligns its opening 50 with the forward opening 42 in the turbine housing. This causes the water jet 54 to be directed in the forward direction, thereby resulting in rearward propulsion for the watercraft. Connection locations 52 around the turbine housing are used to connect the cover plate 36 (see FIG. 4) on the turbine housing for complete assembly. The cover plates are not shown in FIGS. 6 and 7 so that the directional control valve can be clearly seen.

Figure 8:
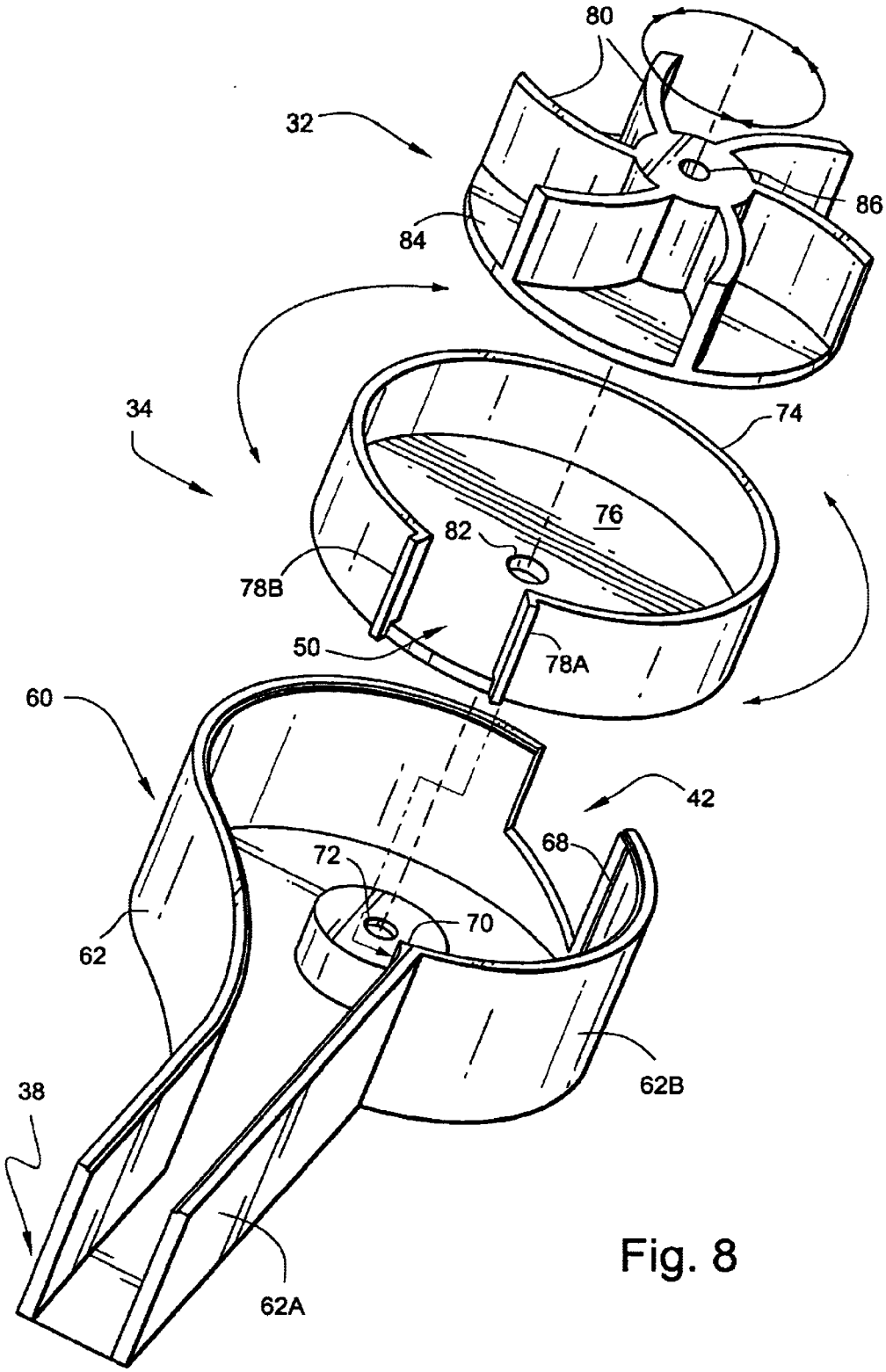
FIG. 8 shows an enlarged, exploded view of the main parts of the preferred embodiment of the turbine mechanism of the instant invention, wherein the directional control valve is positioned for forward propulsion.
Figure 9:
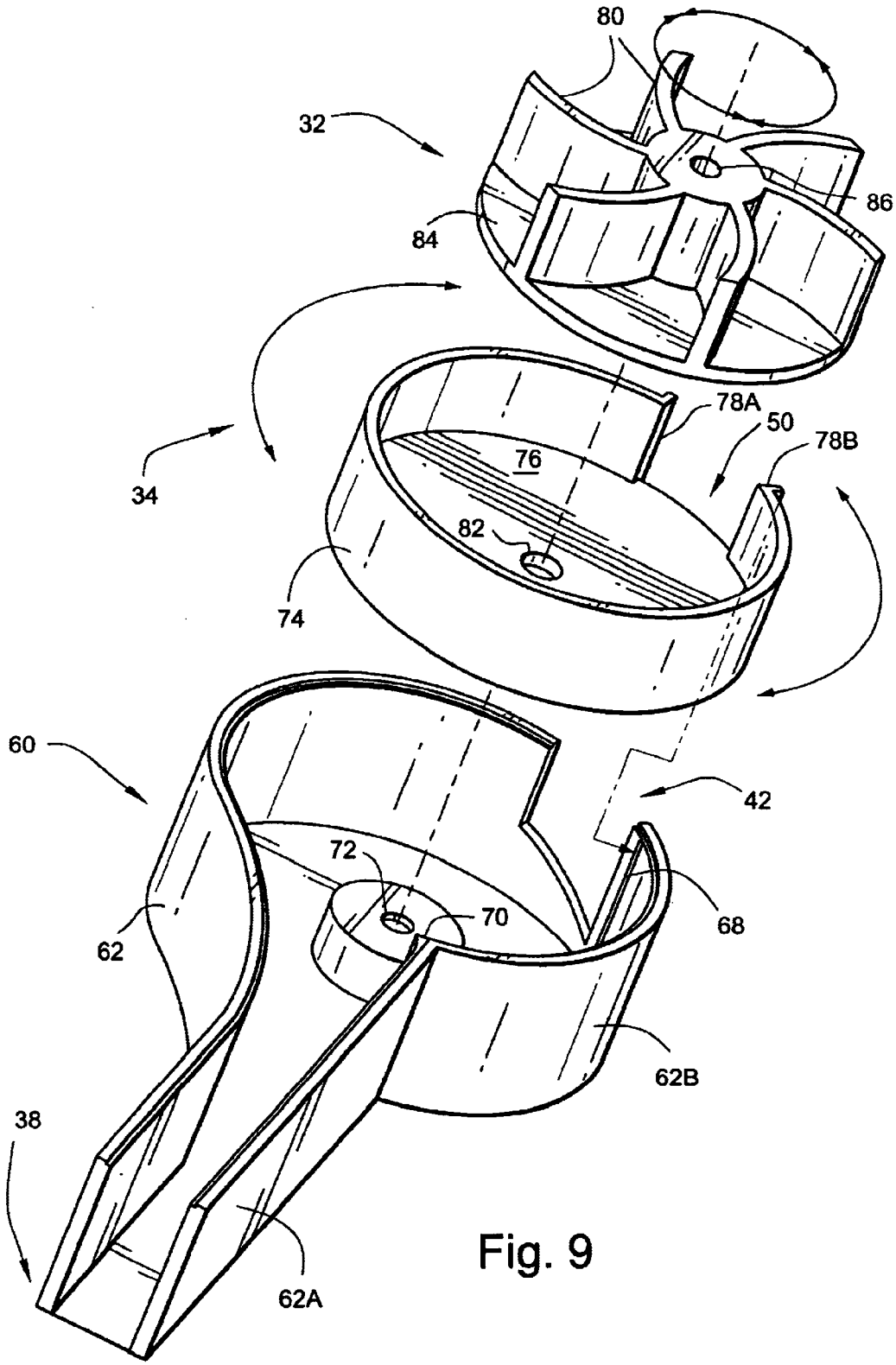
FIG. 9 shows the enlarged, exploded view of the turbine mechanism of FIG. 8, wherein the directional control valve is positioned for rearward propulsion.

FIGS. 8 and 9 show enlarged exploded views of the turbine mechanism of the instant invention, as just described with reference to FIGS. 6 and 7. More particularly, FIG. 8 shows an exploded view of the turbine housing 60, directional control valve 34 and impeller 32 when the impeller rotates clockwise causing the directional control valve to be in the position of FIG. 6 (i.e., providing forward thrust for the watercraft). In this position, the protruding edge 78A abuts against the guiding rib 70 on the turbine housing to maintain the proper alignment between the openings 50 and 38. In contrast, FIG. 9 shows an exploded view of these same parts with the directional control valve 34 positioned for rearward propulsion as shown in FIG. 7. In this position, the protruding edge 78B on the directional control valve 34 abuts against the guiding rib 68 on the turbine housing to maintain the proper alignment of the openings 50 and 42. In other words, the edges 78A, 78B and the guides 68 and 70 cooperate to allow the directional control valve to switch between the first and second positions shown in FIGS. 8 and 9 (and FIGS. 6 and 7) depending on the rotation direction of the impeller.

As can also be seen in FIGS. 8 and 9, the turbine housing 60 preferably has a first portion 62B with a circular shape and a second portion 62A with an elongated shape, thereby defining a racket-shaped turbine housing with a sidewall 62. The forward facing opening 42 is preferably simply a cut-out in the sidewall of the circular portion 62B. However, other arrangements may be used. The elongated portion 62A leads to the rearward opening 38. Other shapes may be used for the turbine housing. The turbine housing is preferably integrally formed in the hull of the watercraft. A central hole 72 is provided for the motor drive shaft to extend therethrough. The directional control valve preferably has a base portion 76 and a sidewall 74 defining a valve interior for receiving the impeller 32 therein. The opening in the valve 34 is preferably defined by a cut-out portion of the sidewall 74. However, other arrangements may be used. A central hole 82 is provided in the base portion 76 for enabling the motor shaft to extend therethrough and connect with the impeller 32. The impeller may have any suitable form and construction, but preferably includes a base plate 84 and a plurality of vanes 80 as shown. A central connection hole 86 is provided in the impeller for use in securing the impeller 32 on the motor drive shaft 30. The turbine housing 60, directional control valve 34, impeller 32 and cover plate 36 may be formed of any suitable material, such as a plastic material.

As can be seen from the above description, the instant invention provides a turbine mechanism for a watercraft that provides directional control and that can be employed to power a toy watercraft in an easy, effective, safe and inexpensive manner. The instant turbine mechanism provides efficient and reliable operation of a toy watercraft, while also increasing safety of the toy due to the fact that none of the moving parts are exposed, because the spinning impeller 32 is housed inside the directional control valve 34 which, in turn, is located inside the turbine housing 60 and incorporated in a recess in the hull portion 28 and covered up by the cover plate 36.

While the preferred forms and embodiment of the instant invention have been illustrated and described herein, it will be appreciated by those skilled in the art that various changes and/or modifications can be made to the invention. Thus, the description herein is only exemplary and is not meant to limit the invention beyond the express language and scope of the appended claims.

What is claimed is:

1. A turbine assembly for use in a toy watercraft, comprising:

a turbine housing defining an impeller cavity and including a forward opening and a rearward opening;

a directional control valve positioned in the impeller cavity and having a valve opening in a sidewall thereof, said directional control valve being operable to rotate to a first position which closes the forward opening in the turbine housing and aligns the valve opening with the rearward opening in the turbine housing, and a second position which closes the rearward opening in the turbine housing and aligns the valve opening with the forward opening in the turbine housing; and an impeller positioned in the directional control valve, wherein rotation of the impeller in a first direction causes the directional control valve to move to the first position and rotation of the impeller in a second direction causes the directional control valve to move to the second position.

2. The turbine assembly of claim 1, wherein the turbine housing is defined by a recess in a hull portion of a toy watercraft.

3. The turbine assembly of claim 1, wherein the directional control valve includes at least one outwardly projecting rib member and the turbine assembly includes at least one inwardly projecting guide member, and further wherein the outwardly projecting rib member on the directional control valve cooperates with the inwardly projecting guide member on the turbine housing to stop rotation of the directional control valve when it reaches the first or second position thereof.

4. The turbine assembly of claim 1, wherein the turbine housing is generally shaped in a form of a racket having an elongated portion that defines the rearward opening in the turbine housing.

5. The turbine mechanism of claim 4, wherein the forward opening in the turbine housing is defined by a cut-out portion of the housing.

6. The turbine mechanism of claim 1, wherein the turbine housing and the directional control valve have aligned motor shaft holes therethrough for enabling a motor shaft to extend through the aligned holes and connect with the impeller for rotationally driving the impeller.

7. The turbine mechanism of claim 1, further including a cover plate for the turbine housing that encloses the directional control valve and the impeller in the turbine housing and provides water inlets for the impeller to draw water into the turbine housing.

8. The turbine mechanism of claim 1, wherein the turbine housing, the directional control valve and the impeller are made of a plastic material.

9. The turbine mechanism of claim 1, wherein the directional control valve includes a circular sidewall and a bottom plate that define an interior portion of the directional control valve, and the impeller is positioned in the interior portion of the directional control valve.

10. The turbine mechanism of claim 9, wherein the turbine housing includes a circular portion that receives the directional control valve.

11. A toy watercraft, comprising:

a watercraft housing having a hull portion;

a motor;

a motor control system for selectively energizing the motor and controlling the direction of operation thereof; and a turbine assembly in the hull portion of the watercraft, including:

a turbine housing defining an impeller cavity and including a forward opening and a rearward opening;

a directional control valve positioned in the impeller cavity and having a valve opening in a sidewall thereof, said directional control valve being operable to rotate to a first position which closes the forward opening in the turbine housing and aligns the valve opening with the rearward opening in the turbine housing, and a second position which closes the rearward opening in the turbine housing and aligns the valve opening with the forward opening in the turbine housing; and an impeller operatively connected to the motor and positioned in the directional control valve, wherein rotation of the impeller in a first direction causes the directional control valve to move to the first position and rotation of the impeller in a second direction causes the directional control valve to move to the second position.

12. The toy watercraft of claim 11, wherein said motor is a miniaturized electric motor.

13. The toy watercraft of claim 12, wherein the motor control system includes a remote control unit.

14. The toy watercraft of claim 11, wherein the turbine housing is defined by a recess in the hull portion of the toy watercraft.

15. The toy watercraft of claim 11, wherein the directional control valve includes at least one outwardly projecting rib member and the turbine assembly includes at least one inwardly projecting guide member, and further wherein the outwardly projecting rib member on the directional control valve cooperates with the inwardly projecting guide member on the turbine housing to stop rotation of the directional control valve when it reaches the first or second position thereof.

16. The toy watercraft of claim 11, wherein the turbine housing is generally shaped in a form of a racket having an elongated portion that defines the rearward opening in the turbine housing.

17. The toy watercraft of claim 16, wherein the forward opening in the turbine housing is defined by a cut-out portion of the housing.

18. The toy watercraft of claim 11, wherein the turbine housing and the directional control valve have aligned motor shaft holes therethrough for enabling a motor shaft of the motor to extend through the aligned holes and connect with the impeller for rotationally driving the impeller.

19. The toy watercraft of claim 11, further including a cover plate for the turbine housing that encloses the directional control valve and the impeller in the turbine housing and provides water inlets for the impeller to draw water into the turbine housing.

20. The toy watercraft of claim 11, wherein the turbine housing, the directional control valve and the impeller are made of a plastic material.

21. The toy watercraft of claim 11, wherein the directional control valve includes a circular sidewall and a bottom plate that define an interior portion of the directional control valve, and the impeller is positioned in the interior portion of the directional control valve.

22. The toy watercraft of claim 21, wherein the turbine housing includes a circular portion that receives the directional control valve.

23. A toy watercraft, comprising:

a watercraft housing having a hull portion;

multiple motors;

a motor control system for selectively energizing the motors and controlling the direction of operation thereof; and multiple turbine assemblies in the hull portion of the watercraft, wherein each turbine assembly includes:

a turbine housing defining an impeller cavity and including a forward opening and a rearward opening;

a directional control valve positioned in the impeller cavity and having a valve opening in a sidewall thereof, said directional control valve being operable to rotate to a first position which closes the forward opening in the turbine housing and aligns the valve opening with the rearward opening in the turbine housing, and a second position which closes the rearward opening in the turbine housing and aligns the valve opening with the forward opening in the turbine housing; and an impeller operatively connected to the motor and positioned in the directional control valve, wherein rotation of the impeller in a first direction causes the directional control valve to move to the first position and rotation of the impeller in a second direction causes the directional control valve to move to the second position.

24. The toy watercraft of claim 23, wherein the turbine assemblies are positioned in side-by-side relation on the hull portion of the watercraft.

25. The toy watercraft of claim 24, wherein the motors are individually controllable with respect to operating speed and direction of rotation, thereby enabling the watercraft to be controlled to operate in both forward and reverse directions and to turn in left and right directions.

* * * * *